US011657991B2

(12) United States Patent
Gauthier et al.

(10) Patent No.: US 11,657,991 B2
(45) Date of Patent: May 23, 2023

(54) ELECTRICAL SWITCH

(71) Applicant: C&K COMPONENTS S.A.S., Dole (FR)

(72) Inventors: Philippe Gauthier, Liesle (FR); Jocelyn Mayot, Sampans (FR)

(73) Assignee: C&K COMPONENTS S.A.S., Dole (FR)

( * ) Notice: Subject to any disclaimer, the term of this patent is extended or adjusted under 35 U.S.C. 154(b) by 0 days.

(21) Appl. No.: 17/658,145

(22) Filed: Apr. 6, 2022

(65) Prior Publication Data

US 2022/0319784 A1 Oct. 6, 2022

(51) Int. Cl.
*H01H 19/14* (2006.01)

(52) U.S. Cl.
CPC ..... *H01H 19/14* (2013.01); *H01H 2215/00* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20; H01H 19/14; H01H 19/11; H01H 19/585; H01H 19/58; H01H 19/62; H01H 19/635; H01H 19/64; H01H 19/63; H01H 19/005; H01H 19/10; H01H 1/2041; H01H 19/56; H01H 19/03; H01H 19/02; H01H 2019/006; H01H 19/00; H01H 19/20; H01H 19/001; H01H 21/50; H01H 2221/01
See application file for complete search history.

(56) References Cited

U.S. PATENT DOCUMENTS

| | | | | |
|---|---|---|---|---|
| 4,451,719 | A | 5/1984 | Lauterburg et al. | |
| 6,952,197 | B1 * | 10/2005 | Nakamura | G06F 3/0338 345/157 |
| 10,475,597 | B2 * | 11/2019 | Taborsky | H01H 3/022 |
| 2021/0265120 | A1 * | 8/2021 | Marcotte | G06F 3/0362 |

FOREIGN PATENT DOCUMENTS

| | | | |
|---|---|---|---|
| DE | 19607562 | C2 | 7/1999 |
| EP | 2624674 | A1 | 8/2013 |

OTHER PUBLICATIONS

K12S High Performance SMT Key Switches, C&K Switches, www.ckswitches.com, D6-8, 2019.

* cited by examiner

*Primary Examiner* — Ahmed M Saeed
(74) *Attorney, Agent, or Firm* — KDW Firm PLLC

(57) ABSTRACT

An electrical switch includes a base, an actuating rod comprising a lateral wall guided in a bore of the base, a return spring for the rod which moves with respect to the base. The return spring comprises a last elastic turn which, during the actuating travel of the rod, bears against an abutment surface of the base and which cooperates with a ramp formed in the side wall which deforms it radially. The bore has a series of axial ribs projecting into the bore, each of which is slidably received in a complementary axial groove formed in the side wall. A radial upper end facet of each axial rib forms a portion of the abutment surface.

10 Claims, 5 Drawing Sheets

ELECTRICAL SWITCH

RELATED APPLICATIONS AND CLAIM OF PRIORITY

This patent document claims priority to French Patent Application No. 2103490 filed Apr. 6, 2021, the entirety of which is incorporated herein by reference.

BACKGROUND

Technical Field

The present invention relates to a long-life, high-reliability electrical switch that provides excellent tactile feel when operated axially.

The invention relates more particularly to an electrical switch in which the tactile sensation results from the cooperation of an elastically deformable ring, and for example the free end turn of a compression coil spring, with a ramp of the upper actuating rod which is passed by the elastic ring which deforms radially during the actuating travel of the switch.

Description of the Related Art

U.S. Pat. No. 4,451,719, which issued May 29, 1984 to Lauterburg and Geiger, and which claims priority to French patent FR2420834, proposes the design of an electrical switch, also called an electric switch, with a tactile effect and axial actuation, comprising, with reference to the Figures of that patent: a lower base or casing 6.

The switch of U.S. Pat. No. 4,451,719 also comprises an upper actuating rod, or push-button, 1 comprising a section 18 whose cylindrical side wall is guided axially in sliding manner in a guide bore formed in the lower base; an elastic member for returning the upper actuating rod to a high rest position, switch in which, under the action of an actuating force applied to the upper actuating rod and against the force exerted by the elastic return member, the upper actuating rod 1 moves axially with respect to the lower base, along an actuating travel, to an active lower position for changing the state of at least one electrical switching way.

The switch of U.S. Pat. No. 4,451,719 also comprises comprising an elastic ring 17 which: (a) is arranged in a peripheral housing formed in the side wall; (b) is traversed axially by the said section of the upper actuating rod; (c) during the actuating travel of the upper actuating rod 1, bears axially downwards against a fixed stop face 18 belonging to the lower base 6; and (d) during the actuation travel of the upper actuation rod 1, cooperates with a cam profile 20 formed in said side wall which radially deforms the said elastic ring to produce an elastic resistance to the actuation of the upper actuation rod.

The detailed description and figures of U.S. Pat. No. 4,451,719 are fully incorporated into this document by reference.

The purpose of such a design is to solve the problem of the user's uncertainty as to the reality of the implementation of the function he has controlled by means of the switch by acting on the upper actuating rod.

This is achieved by the tactile sensation he perceives when he acts on the upper actuating rod.

This principle has been implemented by C&K Components S.A. in the design of its "K12S" pushbutton switch.

The last free end turn of the return spring interacts with the actuator ramp which creates several forces, including a radial force which causes the opening of the last turn and determines the mechanical characteristics of the switch, and an axial force which pushes the last turn of the return spring axially downwards in the direction of the actuating travel, this last turn being in principle axially stopped by the fixed annular stop face belonging to the lower base.

The combination of these two forces causes the last turn to be pushed radially outwards.

There is a risk that the last turn of the spring will be trapped between the ramp of the upper actuating rod and the lower base plate, which can then lead to a significant increase in actuating force and/or to an uncontrolled variation in actuating force and an increase in the range of values of this actuating force in the technical specification of the product.

The present application describes a novel electrical switch that provides improvements over the prior art listed above.

SUMMARY

This document describes a new electrical switch of the aforementioned type which provides a tactile sensation by an elastically deformable ring. In various embodiments of the switch, the guide bore comprises a series of axial ribs, each of which projects radially towards the interior of the guide bore and is slidably received in a complementary axial groove formed in the side wall. The fixed stop surface is constituted by the upper radial end facets of each axial rib.

In some embodiments, the housing may be delimited axially downwards by a lower radial shoulder and upwards by the cam profile.

In any of the embodiments described above, the cam profile may be a cone section whose apex is oriented axially downwards, forming a ramp with which the elastic ring cooperates.

In any of the embodiments described above, each axial groove formed in the side wall may extend axially upwards beyond the cam profile.

In any of the embodiments described above, the elastic return member may include a helical compression spring through which the section of the upper actuating rod passes axially. The lower turn of the helical compression spring may constitute the elastic ring.

Optionally, the helical compression spring may be mounted to be axially compressed between the upper radial end facets of each axial rib and an upper radial shoulder which axially delimits the section upwards.

In some embodiments, an electrical switch with axial actuation includes a lower base comprising a fixed stop surface, an upper actuating rod comprising a section having a cylindrical side wall that is configured to axially slide in a guide bore formed in the lower base, and an elastic member for returning the upper actuating rod to a high rest position. When subjected to an actuating force applied to the upper actuating rod and against the force exerted by the elastic return member, the upper actuating rod is configured to engage in an actuating travel in which the upper actuating rod is displaced axially with respect to the lower base towards an active lower position for changing the state of at least one electrical switching way of the electrical switch. The electrical switch further comprises an elastic ring. The elastic ring is arranged in a peripheral housing formed in the side wall and which is axially traversed by the section of the upper actuating rod which is configured to be, during the actuation travel of the upper actuation rod, in axially downward abutment against the fixed stop surface belonging to the lower base. The elastic ring is also configured to cooperate, during the actuation travel of the upper actuation rod, with a cam profile formed in the side wall, which deforms the elastic ring radially in order to produce an elastic resistance to the actuation travel of the upper actuation rod. The guide bore comprises a series of axial ribs, each of which projects radially inwardly of the guide bore and is slidably received in a complementary axial groove formed in the side wall. The fixed abutment surface is constituted by the radial upper end facets of each axial rib.

BRIEF DESCRIPTION OF THE DRAWINGS

Further features and advantages of the invention will become apparent from the following detailed description, for the understanding of which reference is made to the attached drawings in which.

DETAILED DESCRIPTION

For the description of the invention and the understanding of the claims, the vertical, longitudinal, and transverse orientations, according to the reference V, L, T shown in the figures, whose longitudinal L and transverse T axes extend in a horizontal plane, will be adopted by way of non-limitation and without restrictive reference to terrestrial gravity. By convention, the vertical axis V is oriented from bottom to top.

In the following description, identical, similar or analogous elements will be referred to by the same reference numbers.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to."

First Example of an Embodiment

In the following example, the electrical switch 20 is generally symmetrical in design with respect to the median vertical and longitudinal plane, and with respect to the median vertical and transverse plane.

Figure 1:
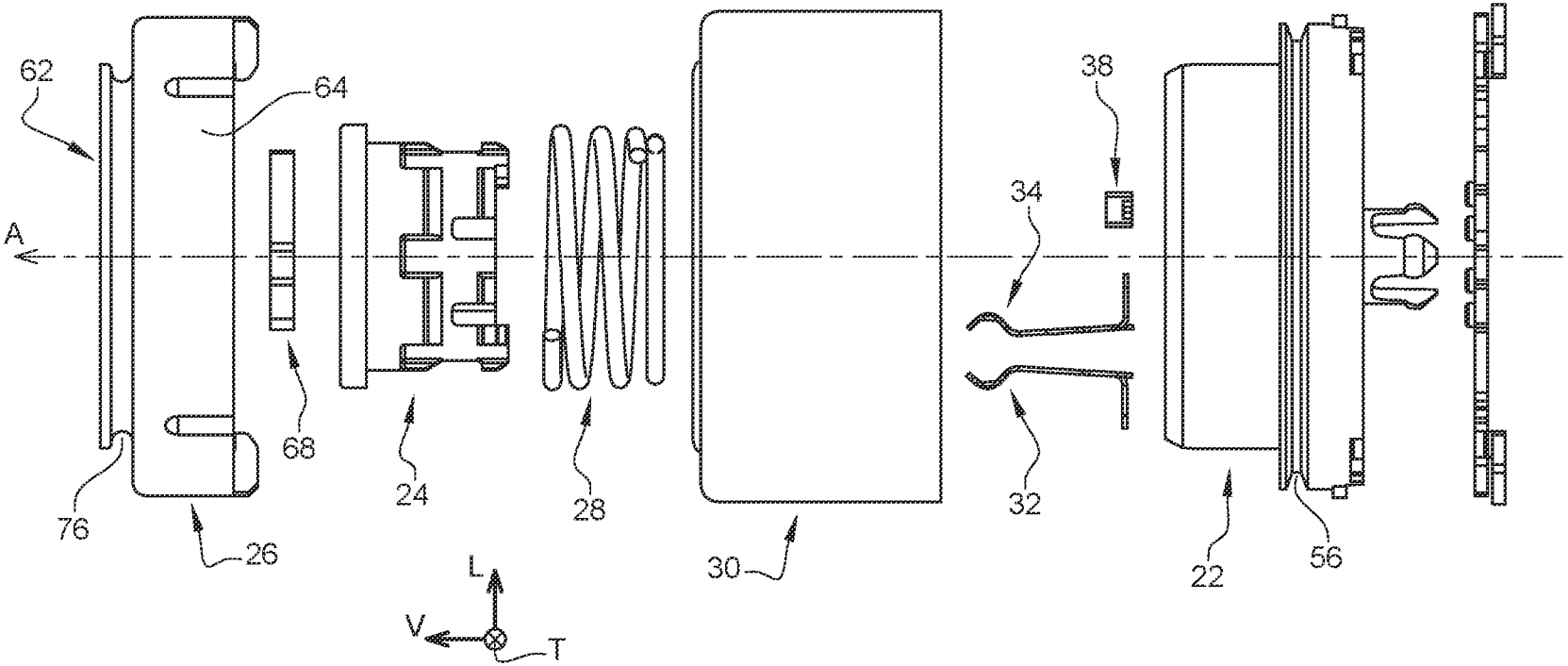
FIG. 1 is an exploded side view of an example embodiment of an electrical switch according to the invention.
Figure 2:
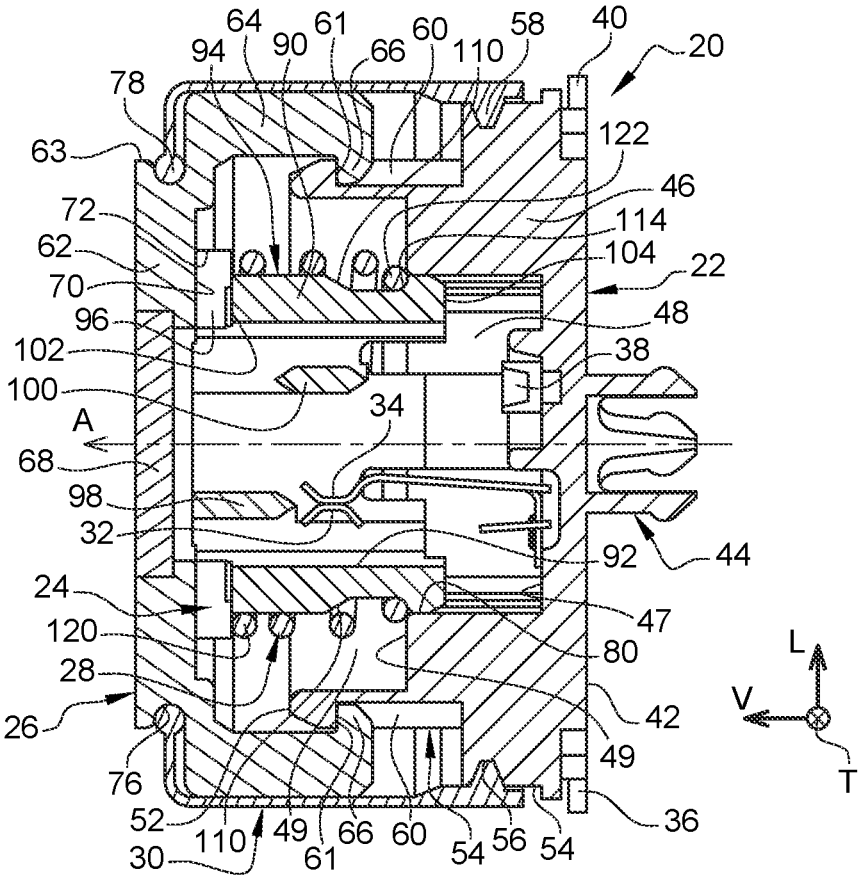
FIG. 2 is a cross-sectional view, through a longitudinal and vertical median plane, of the switch in FIG. 1.
Figure 3:
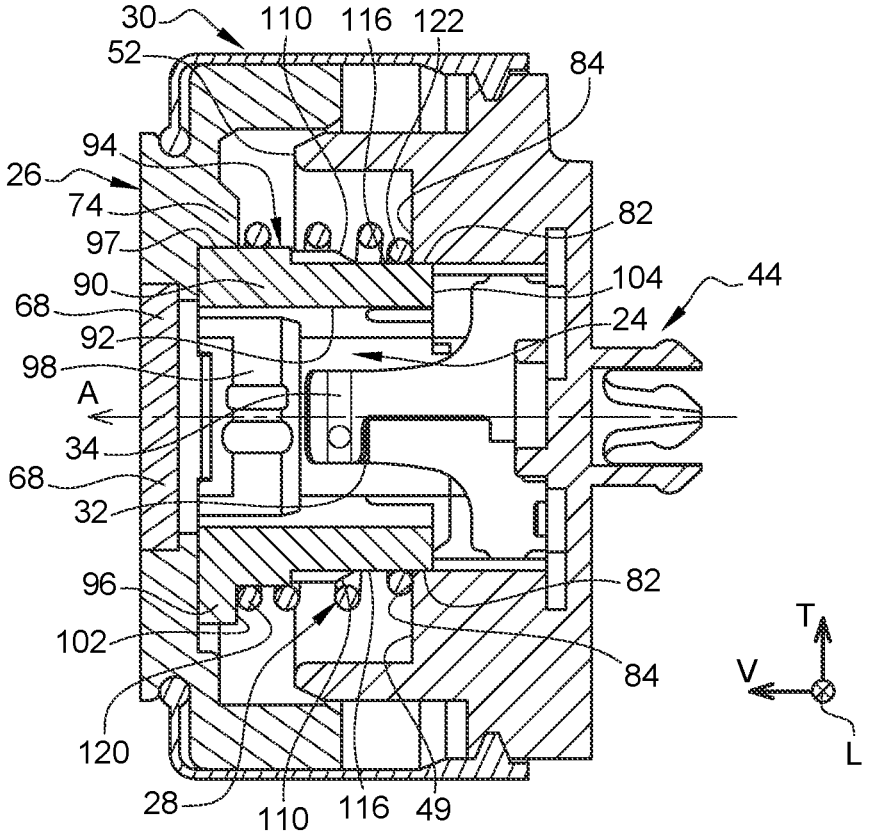
FIG. 3 is a cross-sectional view, through a vertical and transverse median plane, of the switch in FIG. 1.
Figure 4:
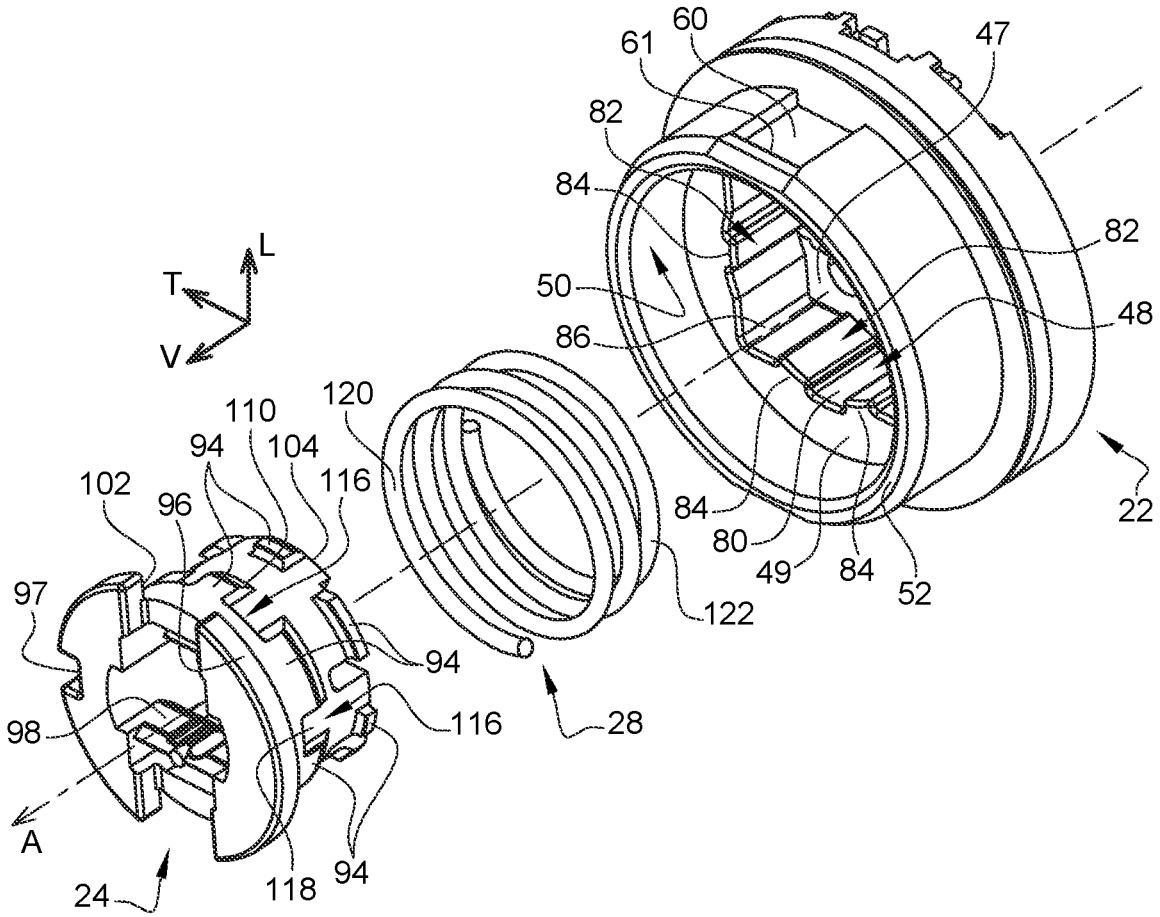
FIG. 4 is an exploded perspective view of the lower baseplate, return spring and upper actuating rod of the switch of FIG. 1.
Figure 5:
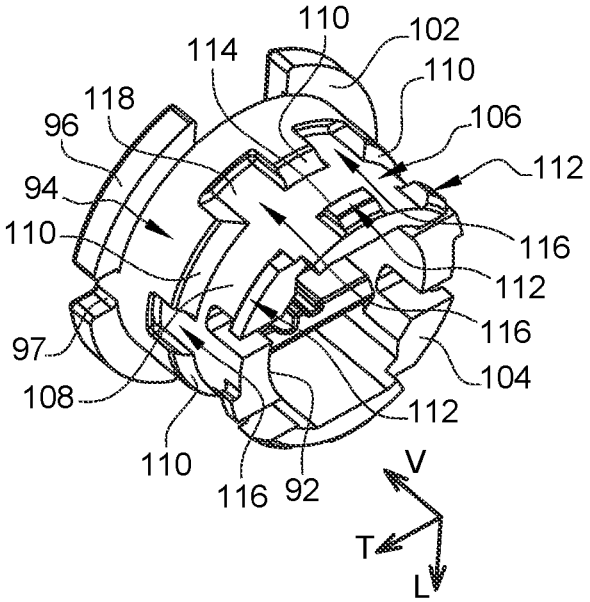
FIG. 5 is a perspective view of the upper actuating rod of the switch in FIG. 1.

Vertically from bottom to top, the electrical switch 20—which is illustrated in particular in FIGS. 1 to 3—comprises a lower base 22 and an upper actuating rod 24 which is mounted so as to be slidable, along the main vertical axis A, relative to the lower base 22.

The lower base 22, which forms a housing, is closed at the top by an upper actuating cover 26, which is mounted so as to be axially displaceable relative to the lower base 22.

The electrical switch 20 further comprises a compression coil spring 28 which is axially interposed between the upper actuating rod 24 and the lower base 22, and a flexible lateral sealing membrane 30 which cooperates with the upper actuating cover 26 and the lower base 22.

The electrical switch 20 also comprises two elastically deformable electrical contact blades 32 and 34, each of which is connected to a connection terminal 36. Thus, by way of example, the electrical switch 20 is here of the normally closed type in which, in the absence of actuation, the two electrical contact blades 32 and 34 elastically abut each other and establish the electrical switching way or path between two associated connection terminals 36.

As a non-limiting example, the electrical switch 20 is of the luminous type and for this purpose comprises a light source 38 which, for example, is a light-emitting diode and which is connected to connection terminals 40 for its supply.

The lower base 22 is moulded from plastic around the electrical connection elements of the electrical contact blades 32 and 34 and the light source 38.

The lower base is 22 in the form of a cylindrical housing of axis A, the lower face 42 of which has a pin 44 for fixing to a support element (not shown) such as a printed circuit board.

The main body 46 of the lower base 22 defines a lower cavity 48 which is open vertically upwards and an upper cavity 50 of generally circular cylindrical shape which is also open upwards and is defined by the upper edge 52 of the lower base 22.

The two cavities 48 and 50 are delimited from each other by a horizontal radial face 49 which is oriented vertically upwards.

The electrical contact blades 32 and 34 extend vertically upwards within the lower base 22 from the bottom 47 of the lower cavity 48. The light source 38 is also arranged in the bottom 47 of the lower cavity 48.

The side wall 54 of the lower base 22 has a lower radial groove 56 into which a complementary annular rib 58 of the sealing membrane 30 is elastically fitted, and two diametrically opposed vertical axial grooves 60, closed at their upper ends.

The upper actuating cover 26 comprises a horizontal top plate 62 and a cylindrical tubular side wall 64 which comprises two diametrically opposed hooks 66 which extend generally inwardly and each of which is received in an associated groove 60 in the side wall 54 of the lower base 22.

The top plate 62 is centrally perforated and is here closed by a translucent or transparent plate 68 which may, for example, be colored and/or have a pattern and which may allow the lighting of the light source 38 to be viewed.

The inner bottom face 70 of the top plate 62 defines a housing 72 which is open axially downwards and has a radial angular indexing finger 74.

The side wall 63 of the top plate 62 has an internal radial groove 76 into which a complementary annular bead 78 of the sealing membrane 30 is elastically fitted.

The lower cavity 48 of the lower base has 22 an axial guiding bore 80 in the form of a series of concave sections, of which there are six in this case.

The axial guide bore 80 thus formed extends vertically upwards from the bottom 47 and opens axially into the face 49.

In accordance with the invention, the lower cavity 48 of the lower base 22 also has a series of vertical axial ribs 82 each of which extends radially inwardly from the concave cylindrical surface of the guiding bore 80.

Figure 9:
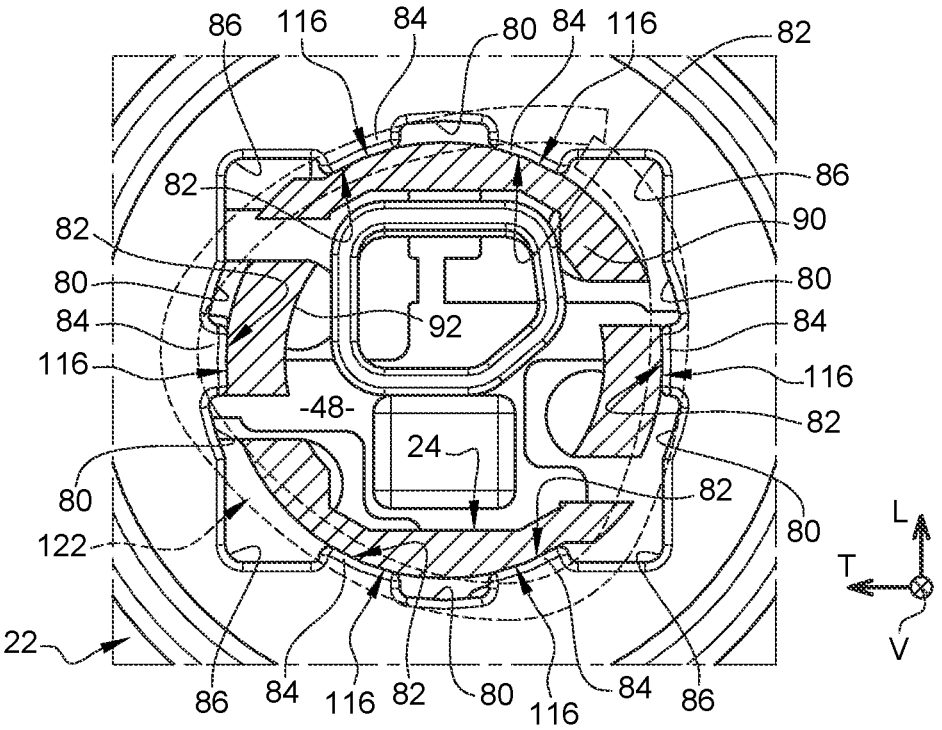
FIG. 9 is a partial cross-sectional view through a longitudinal and transverse plane along line 9-9 of FIG. 8A.

By way of illustration, and as can be seen in particular in FIG. 9, the ribs 82 are eight in number and comprise two pairs of upper and lower ribs and two transversely opposed lateral ribs.

Each rib 82 is bounded axially upwards by an upper radial end facet 84 which is coplanar with face 49.

Thus, in the sense of the invention, the eight facets 84 are stop facets each constituting a portion of a horizontal stop face which is oriented vertically upwards for axial downward support of the return spring.

The lower cavity 48 of the lower base 22 further has four recesses 86 arranged at a ninety-degree angle.

The upper actuating rod 24 includes a plastic moulding having a hollow tubular body 90 which is bounded by an inner concave cylindrical wall 92 and a convex cylindrical side wall 94.

At its upper end, the body 90 extends into an upper cylindrical radial plate 96 which is received in the housing 72 and which has an angular indexing notch 97 in which the indexing finger 74 of the actuating cover 26 is received.

Inside the tubular body 90, the upper actuating rod 24 has two diametral plates 98 and 100 which are suitable for acting on electrical contact elements.

In the example shown in the figures, it is the diameter plate 98 which is adapted to cooperate with the two electrical contact blades 32 and 34 to move them longitudinally away from each other in order to interrupt the electrical switching way with which they are associated.

Thus, considering the rest position illustrated in FIG. 2, an axial downward displacement of the plate 98 causes an opening of the electrical contact constituted by the two electrical contact elements 32 and 34 on which it acts by elastically deforming them to move them away from each other.

Such actuation is obtained by acting on the upper actuating cover 26 which pushes axially on the upper radial plate 96 of the upper actuation rod 24 to move the latter axially downwards relative to the lower base 22 and thus relative to the electrical contact elements 32 and 34.

The side wall 94 of the upper actuating rod 24 extends axially from the lower annular radial face 102 of the radial plate 96 to the lower axial annular end radial face 104.

The side wall 94 of the upper actuating rod 24 has an internal radial groove 106 which is bounded by a convex cylindrical bottom wall 108.

The groove 106 is delimited axially upwards by a frustoconical upper radial shoulder 110, the apex of which is oriented downwards and which constitutes a connecting ramp between the bottom wall 108 of the radial groove 106 and the convex side wall 94 of the upper actuating rod 24.

The groove 106 is bounded axially upwards by a lower radial shoulder 112 which is bounded axially by an axially upward facing radial face 114.

In accordance with the teachings of the invention, the side wall 94 of the upper actuating rod 24 has a series of vertical axial grooves 116 each of which extends radially inwardly from the surface of the convex cylindrical side wall 94.

The profile of the bottom wall 118 of each axial groove 116 is here common to the convex cylindrical profile of the bottom wall 108 of the radial groove 106.

Each axial groove 116 opens axially downwards into the annular radial lower axial end face 104.

The number, dimensions, and angular distribution of the axial grooves 116 are identical and complementary to those of the axial ribs 82 of the lower base 22.

Thus, as can be seen in particular in FIG. 9, in the assembled position in which the side wall 94 of the upper actuating rod 24 is received and axially slidably guided in the guiding bore 80, each axial rib 82 is axially slidably received in a complementary axial groove 116 of the upper actuating rod 24.

The return spring 28 is a helical compression spring, also known as a coil spring, whose circular cylindrical body is penetrated by the upper actuating rod 24.

The upper end spiral 120 is here of generally circular shape and is axially supported against the lower annular radial face 102 of the radial plate 96.

The lower end turn 122, also known as the last turn or coil of the return spring 28, is here generally triangular in shape and is axially abutting the axially upwardly facing radial face 114 of the lower radial shoulder 112.

Figure 6:
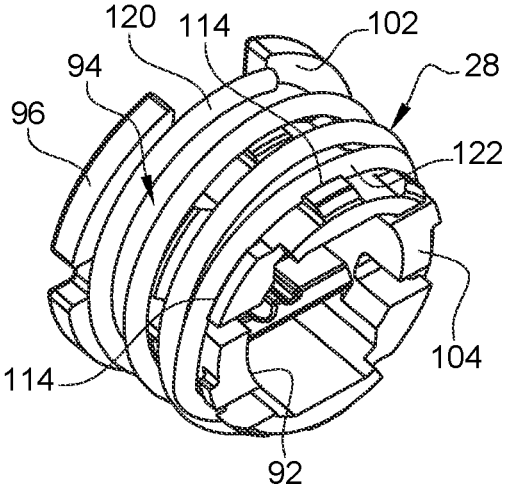
FIG. 6 is a perspective view of the upper actuating rod and return spring of the switch in FIG. 1.
Figure 7:
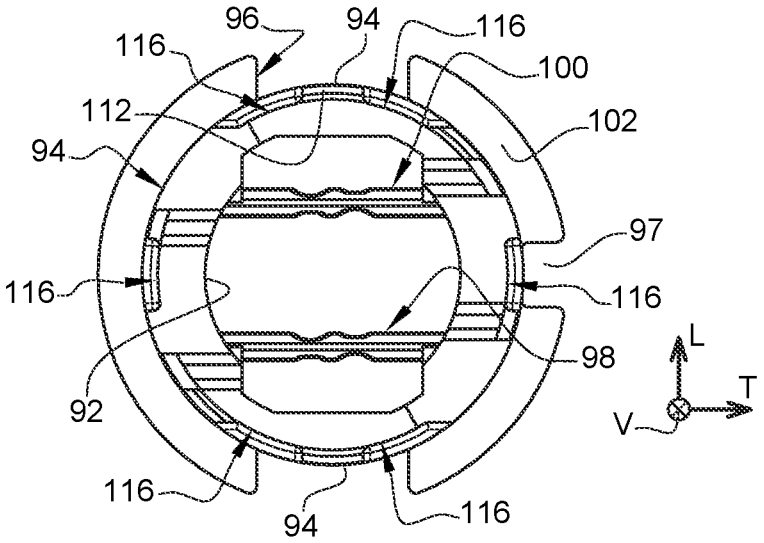
FIG. 7 is an axial end view of the upper actuating rod of the switch in FIG. 1.
Figure 8A:
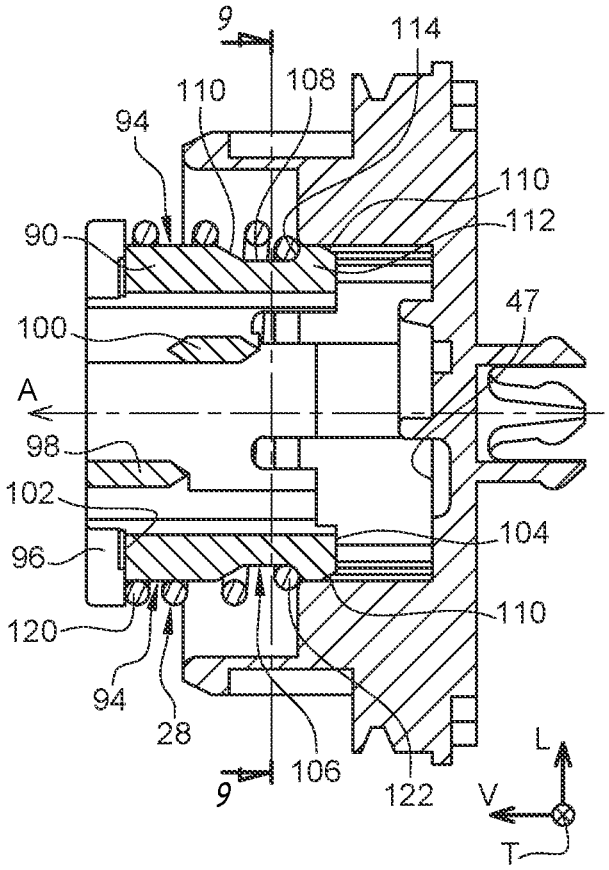
FIG. 8A is a cross-sectional view through a median longitudinal and transverse plane of the lower base, return spring and upper actuating rod of the switch of FIG. 1 with the upper actuating rod shown in the upper rest position.
Figure 8B:
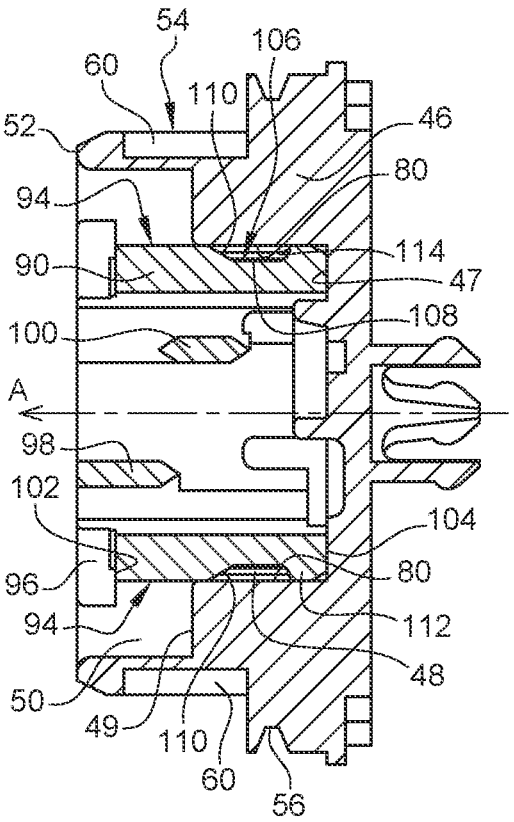
FIG. 8B is a similar view to FIG. 8A in which the upper actuating rod is shown in the active down position, without the return spring.

Thus, as can be seen for example in FIG. 6, when assembling the spring to the actuating rod, the return spring is mounted slightly axially compressed without play between the opposing radial faces 102 and 114.

In this initial state of the return spring 28, and as can also be seen in FIGS. 2 and 3, the last turn 122 is arranged in the recess in the side wall 94 of the upper actuating rod 24 constituted by which the radial groove 106.

The average internal diameter of the last turn is reduced relative to the internal diameter of the other turns so as to be adjacent to the convex cylindrical side wall of the radial groove 106. In this way, the turn 122 is axially supported on the facets 84 and the tactile sensation during actuation is optimized.

In the upper rest position of the upper actuating rod 24, the last turn 122 is in downward axial abutment against the radial face 49 of the lower base 22 and the spring 28 exerts a elastic upward return force on the upper actuating rod 24, this upper rest position being determined by the upward axial abutment of the hooks 66 against the upper bottom 61 of the axial grooves 60.

As can be seen in detail in FIG. 9, different sections of the last turn 122 of the return spring 28 are in axial abutment against a facet 84 of an axial rib 82 or extend opposite a facet 84 of an axial rib 82. In each case, the facet 84 thus may be considered to be a stop surface or abutment surface of the housing Thus, when the switch is actuated and the upper actuating rod 24 is pushed axially downwards against the elastic return force applied to it by the spring 28, the last turn 122 is supported axially on the facets 84 without any risk of this turn 122 becoming jammed between the upper actuating rod 24 and the lower base 22, even when the last turn 122 cooperates with the cam profile constituted by the frustoconical ramp 110.

Second Example Embodiment

Figure 10:
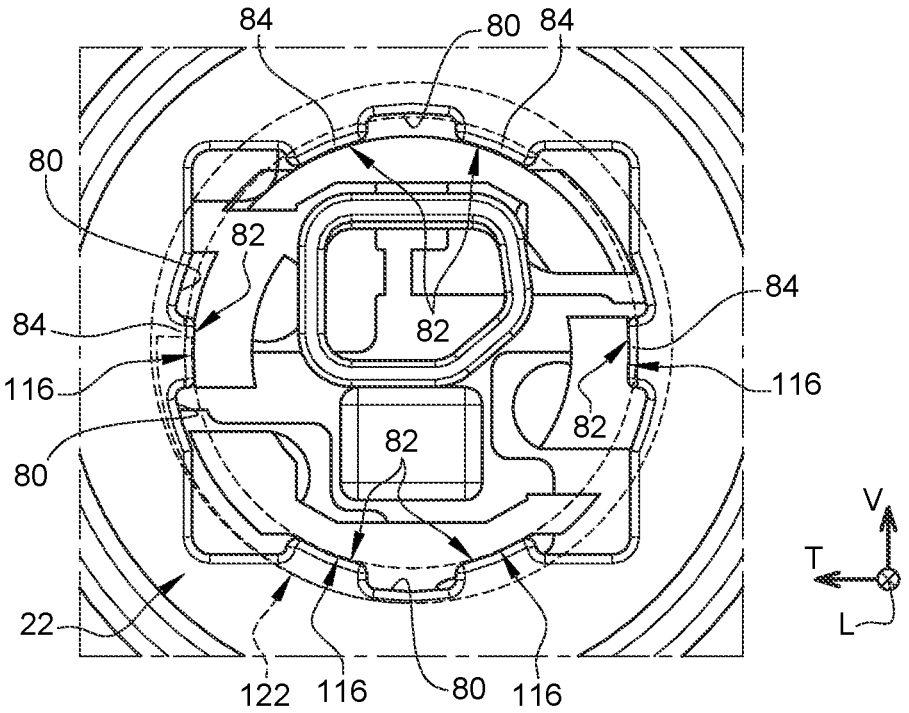
FIG. 10 is a similar view to FIG. 9 which shows a second example of the return spring design with a circular lower end turn.

The second embodiment shown in FIG. 10 is similar to that shown in FIG. 9, except that the last turn 122 of the return spring 28 is generally circular in shape. Otherwise, as with the first embodiment shown in FIG. 9, the abutment facet 84 of axial rib 82, as well as the guiding bore 80.

vertical axial grooves 116, lower base 22 and other elements of the switch, are arranged as they are in the first embodiment of FIGS. 1-9.

Thus, when the switch is actuated and the upper actuating rod 24 is pushed axially downwards against the elastic return force applied to it by the spring 28, the last turn 122 is supported axially on the facets 84 without any risk of this turn 122 becoming jammed between the upper actuating rod 24 and the lower base 22, even when the last turn 122 cooperates with the cam profile constituted by the frusto-conical ramp 110.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. An electrical switch with axial actuation, the electrical switch comprising:

a lower base;

an upper actuating rod comprising a section having a cylindrical side wall that is configured to axially slide in a guide bore formed in the lower base; and an elastic member for returning the upper actuating rod to a high rest position;

wherein, when subjected to an actuating force applied to the upper actuating rod and against the force exerted by the elastic return member, the upper actuating rod is configured to be engage in an actuating travel in which the upper actuating rod is displaced axially with respect to the lower base towards an active lower position for changing a state of at least one electrical switching way of the electrical switch;

wherein the electrical switch further comprises an elastic ring which:

is arranged in a peripheral housing formed in the side wall which is axially traversed by the section of the upper actuating rod and which is configured to be, during the actuation travel of the upper actuation rod, in axially downward abutment against a stop surface belonging to the lower base;

is configured to cooperate, during the actuation travel of the upper actuation rod, with a cam profile formed in the side wall which deforms the elastic ring radially in order to produce an elastic resistance to the actuation travel of the upper actuation rod;

and further wherein:

the guide bore comprises a series of axial ribs, each of which projects radially inwardly of the guide bore and is slidably received in a complementary axial groove formed in the side wall, and the stop surface is constituted by radial upper end facets of each axial rib.

2. The electrical switch of claim 1, wherein the housing is delimited axially downwards by a lower radial shoulder and upwards by the cam profile.

3. The electrical switch of claim 2, wherein the cam profile comprises a cone section having an apex that is oriented axially downwards, forming a ramp with which the elastic ring cooperates.

4. The electrical switch of claim 2, wherein each axial groove formed in the side wall extends axially upwardly beyond the cam profile.

5. The electrical switch of claim 3, wherein each axial groove formed in the side wall extends axially upwardly beyond the cam profile.

6. The electrical switch of claim 1, wherein:

the elastic return member comprises a helical compression spring through which the section of the upper actuating rod passes axially; and a lower turn of the helical compression spring constitutes the elastic ring.

7. The electrical switch of claim 6, wherein the helical compression spring is mounted axially compressed between:

the upper radial facets of each axial rib; and an upper radial shoulder which axially delimits the section of the upper actuating rod upwards.

8. The electrical switch of claim 7, wherein the housing is delimited axially downwards by a lower radial shoulder and upwards by the cam profile.

9. The electrical switch of claim 8, wherein the cam profile comprises a cone section having an apex that is oriented axially downwards, forming a ramp with which the elastic ring cooperates.

10. The electrical switch of claim 8, wherein each axial groove formed in the side wall extends axially upwardly beyond said cam profile.

* * * * *